US006464100B2

(12) United States Patent
Canfield

(10) Patent No.: US 6,464,100 B2
(45) Date of Patent: Oct. 15, 2002

(54) CONTAINER INSULATOR

(76) Inventor: Charles L. Canfield, 4925 Greenville Ave. Suite 1077, Dallas, TX (US) 75206

( * ) Notice: Subject to any disclaimer, the term of this patent is extended or adjusted under 35 U.S.C. 154(b) by 0 days.

(21) Appl. No.: 09/681,730

(22) Filed: May 29, 2001

(65) Prior Publication Data

US 2001/0027979 A1 Oct. 11, 2001

Related U.S. Application Data

(63) Continuation-in-part of application No. 09/470,696, filed on Dec. 23, 1999, now abandoned, which is a continuation-in-part of application No. 09/138,753, filed on Aug. 24, 1998, now abandoned.

(51) Int. Cl.[7] ..... B65D 81/14; B65D 8/00
(52) U.S. Cl. ..... 220/739; 220/737
(58) Field of Search ..... 220/739, 737; 229/453; 248/311.2

(56) References Cited

U.S. PATENT DOCUMENTS

| | | | | |
|---|---|---|---|---|
| 538,699 A | | 5/1895 | Redlich | |
| 2,142,301 A | | 1/1939 | Buchalter | |
| 2,589,645 A | | 3/1952 | Tiegel | |
| 2,600,911 A | | 6/1952 | Olson | |
| 2,757,790 A | | 8/1956 | Gattuso | |
| 3,031,691 A | | 5/1962 | Caldemeyer et al. | |
| 3,680,726 A | | 8/1972 | Massey | |
| 3,738,529 A | | 6/1973 | Rose | |
| 3,813,801 A | | 6/1974 | Vander Schaaf | |
| 3,910,328 A | | 10/1975 | Marcoux | |
| 3,941,237 A | | 3/1976 | MacGregor, Jr. | |
| 4,268,567 A | | 5/1981 | Harmony | |
| 4,282,279 A | | 8/1981 | Strickland | |
| 4,293,015 A | | 10/1981 | McGough | |
| 4,344,303 A | | 8/1982 | Kelly, Jr. | |
| 4,376,703 A | | 3/1983 | Krauss | |
| 4,399,668 A | | 8/1983 | Williamson | |
| 4,401,245 A | | 8/1983 | Zills | |
| 4,514,995 A | | 5/1985 | Curtis et al. | |
| 4,540,611 A | * | 9/1985 | Henderson | 220/739 |
| 4,549,410 A | | 10/1985 | Russell | |
| 4,583,577 A | | 4/1986 | Canfield | |
| 4,921,117 A | | 5/1990 | Mucciarone | |
| 4,928,873 A | * | 5/1990 | Johnson | 220/739 |
| 5,152,709 A | | 10/1992 | Johnson, III et al. | |
| 5,325,991 A | * | 7/1994 | Williams | 220/739 |
| 5,579,949 A | * | 12/1996 | Dykes et al. | 220/739 |
| 5,609,265 A | | 3/1997 | Haberkorn et al. | |
| 5,680,944 A | * | 10/1997 | Rueter | 220/739 |

* cited by examiner

*Primary Examiner*—Joseph M. Moy
(74) *Attorney, Agent, or Firm*—Jeffrey T. Hubbard; Kelly & Hubbard

(57) ABSTRACT

An insulating cover for a container has a substantially cylindrical sidewall member and a contiguous bottom member. The sidewall and bottom members are preferably formed from a thin sheet of insulating material. The sidewall member has end sections that overlap in an unexpanded orientation. The bottom member has an annular portion than can be adapted to engage the bottom of the container. In another embodiment, a number of substantially identical tabs engage the bottom of the container. The tabs extend from the inner radius of the bottom member annular portion toward the axis of the sidewall member, and are spaced apart so that they do not overlap.

4 Claims, 2 Drawing Sheets

CONTAINER INSULATOR

TECHNICAL FIELD

This invention relates in general to container insulating devices. In particular, the invention relates to an improved flexible insulating wrapper for beverage containers and the like.

BACKGROUND OF INVENTION

Numerous types of insulators are available for insulating beverage containers such as cans and bottles for soft drinks and beer. Many types have attempted and failed to provide a simple wrap-around device that can hold the container even during use without adding substantial bulk, and can be manufactured mainly from the insulating material itself without having to assemble several separate pieces. Examples of devices that fail to exhibit all the desired features are disclosed in U.S. Pat. Nos. 3,813,801 to Vander Schaaf, 4,344,303 to Kelly Jr., and U.S. Pat. No. 4,549,410 to Russel. These structures lack bottoms for keeping the container from falling out of the insulator, create a relatively bulky package in combination with the container, or use complex, multi-part assemblies usually containing expensive and rigid materials.

An insulating device that exhibits all the above mentioned features is described in U.S. Pat. No. 4,583,577 (hereafter the '577 patent), issued to the inventor and incorporated herein by reference. The insulator has the advantages that it can be nested for shipping and storage, and that the insulated container can be placed within the type of supportive beverage holder typically available in cars, boats and other vehicles. Various other advantages and features of the design are enumerated in the '577 patent.

The device disclosed in the '577 patent has an sidewall part made from a strip of insulating material formed into a roll, and a bottom member made up of a plurality of bottom segments that provide support for the container and hold the container within the insulator. The ends of the sidewall strip are designed to overlap, allowing the effective radius of the sidewall to adjust automatically to conform to the container inserted within it. The bottom segments are substantially triangular in shape, and are designed to interleave like a camera iris. While this type of structure works with normal containers, experience has shown that the segments can sag when supporting a heavier than average container. Furthermore, the areas where the individual bottom segments join the sidewall strip weaken with repeated load cycles, so that the bottom segments sag still further and can even fail to hold the container inside the device during use. A structure that has greater strength and resistance to sagging, and that retains this strength and sagging resistance over many cycles, is therefore desired. Also, in many cases it is preferred that the bottom of the insulator lie flat on the supporting surface. This cannot be achieved with the '577 structure due to the overlapping nature of the segments. A desirable structure could also cushion containers that are packaged collectively (for example, six-packs of glass bottles) to protect the containers from breakage that can occur during shipping and handling when the individual containers strike one another. The improved structure should retain the '577 structure's ability to form a snug, friction fit with the container, and automatically adjust to provide this fit over a range of container diameters, yet still allow a container to be inserted into and removed from the insulating cover with less force than existing structures. Finally, it is preferred that the improved structure be capable of being expanded and contracted without the individual elements of the device interfering with one another.

SUMMARY OF INVENTION

In general, a structure having the desired features and advantages has a sidewall member and an bottom member formed integrally from a single piece of insulating material. The sidewall member has ends that overlap when the device is in an unexpanded orientation, which is defined as the orientation of the device at rest without a container in the device. The sidewall member also forms a frusto-conical shell in the unexpanded orientation, to aid nesting of the devices within one another. The bottom member has an solid, continuous annular portion extending from the bottom edge of the sidewall member. In one embodiment, this annular portion alone is used to engage the bottom of the container, but the preferred embodiment includes a number of tabs extending from the annular portion toward the axis of the cylinder formed by the sidewall member. The tabs in this embodiment are designed to engage the bottom of the container rather than the annular portion. The tabs are spaced sufficiently far apart so that they do not overlap even when the cover is in the unexpanded orientation.

Additional features and advantages of the invention will become apparent in the following detailed description and in the drawings.

DETAILED DESCRIPTION

Figure 1:
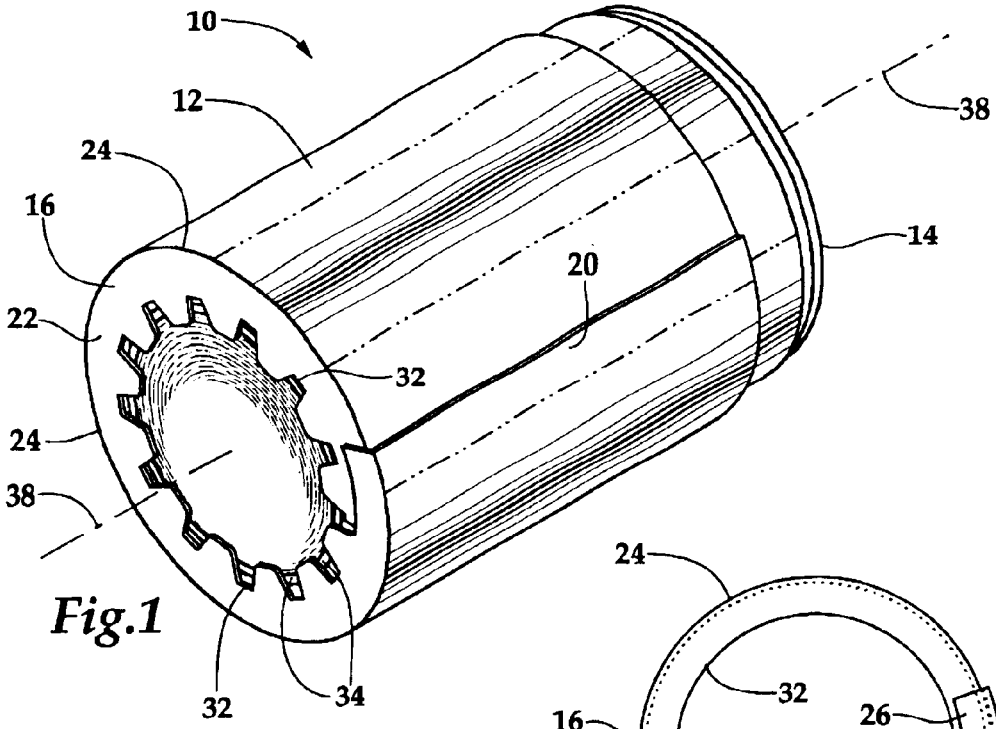
FIG. 1 is a bottom perspective view of an insulating cover according to the invention, as it appears when in use on a soft drink or beer can.
Figure 2:
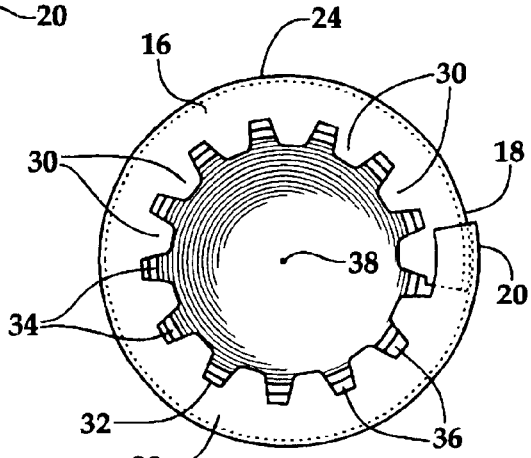
FIG. 2 is a bottom plan view thereof, showing the details of the bottom member.

FIGS. 1 and 2 show the preferred embodiment of the cover 10 of the invention in use on a container. The cover 10 comprises a sidewall member 12 adapted to wrap about the container 14, and a bottom member 16 that prevents the container 14 from falling through the sidewall member 12 when the combination of insulating cover and container is picked up.

The insulating cover 10 is constructed from a single thin sheet of insulating material having the desired mechanical properties. The material should be capable of being flexed repeatedly during expected use without cracking, and should be able to be permanently heat formed to a desired shape. Materials already tested and found suitable include polyethylene foam and polystyrene foam, although other materials known in the art can be used.

Sheet material about 25 mil (0.635 millimeter) thick has been used to construct devices with the '577 patent structure. Devices made from polyethylene foam or polystyrene foam with this thickness have a tendency to sweat when insulating a cold container. The use of thicker material, such as sheets having a thickness of 40 mil (1.02 millimeter) is preferred, both for its improved insulating ability and for its increased strength. The 40 mil (1.02 millimeter) sheet reduces the sweating problem substantially while retaining the remaining '577 advantages such as the ability to place container and cover in a vehicle's beverage holder without binding. The combination of container and cover can also be packed in the same manner as the containers alone. The thinner material is still suitable, especially when materials having greater insulating properties are used.

The cover 10 is made from a single piece of the material, and shaped by means described in the '577 patent. The material is wrapped around a form and heated by blowing hot air over the formed material, although other methods for heating and forming the cover can be used. The form can be cylindrical in shape, but the preferred shape is that of a frustum, or truncated round cone. The cover 10 is formed with the bottom of the sidewall 12 being formed on the small end of the form. The cover 10 will then have an unexpanded orientation like that shown in FIG. 5, with the inside diameter of the sidewall upper opening 13 being at least the same as, and preferably slightly larger than, the outside diameter of the sidewall bottom 15. This slight flaring of the upper opening 13 has been found to improve the ability to nest covers inside each other.

The sidewall member 12 has two end pieces 18 and 20 that overlap each other. The area of overlap decreases due to the expansion of the sidewall member 12 from insertion of the container 14. If desired, the sidewall member 12 can be designed so that the end pieces 18 and 20 do not overlap when the container 14 is in the insulating cover 10. The sidewall member 12 adjusts to form a snug, friction fit against the container 14. An advantage of the invention is that the cover will automatically adjust itself to fit properly for a range of container sizes and does so without the need for added steps such as adjusting fasteners or straps. For example, a single insulating cover 10 can easily adjust itself to all common types of soft drink and beer cans, which vary from about 2.4 to 2.6 inches (61 to 66 mm) in diameter, depending on source. The invention can be manufactured in different sizes to handle container sizes beyond the range of a single insulating cover 10. Even though the insulating cover 10 friction fits against the container, the force required to insert and remove a container from the insulating cover 10 is small, and is significantly less than the force required for conventional devices such as foam rubber sleeves.

As already described, the insulating cover 10 can easily be nested (i.e. multiple devices can be placed around each other, like multiple layers of clothing). This ability, along with the insulating cover's snug, friction fit allows the insulating cover 10 to handle more demanding insulating requirements simply by slipping on additional insulating covers 10. These additional covers can be added up to the outer design range for expansion of the device, resulting in an overall thickness of the insulating material that can equal or exceed that of conventional designs.

Turning to FIG. 2, the bottom member 16 has an annular portion 22 contiguous with the sidewall member 12 along a common bottom edge 24. Bottom sections 26 and 28 at the ends of the annular portion 22 overlap when the cover 10 is in the unexpanded orientation. As in the case of the sidewall member 12, the bottom member 16 can be designed so that the bottom sections 26 and 28 do not overlap with a container in the cover. This is a more desirable feature for the bottom member 16, as this results in a more stable rest surface, and little effort is required to realign the bottom sections 26 and 28 for overlapping.

As can be seen in FIGS. 1 and 2, in the preferred embodiment a number of substantially identical tabs 30 extend from the inner radius 32 of the annular portion 22 toward the axis 38 of the cylindrical sidewall member 12. While the tabs 30 are shown having a substantially trapezoidal shape, other shapes can be used.

Many soft drink and beer cans are presently manufactured with a bottom configuration ending in a ring-shaped bottom rim 34 that can have a significantly smaller radius than that of the entire container 14. The tabs 30 are adapted to engage the bottom rim 34. The tabs 30, in conjunction with the annular portion 22, should be stiff enough to support the expected load, while leaving the annular portion 22 narrow enough to allow it to flex without cracking between the unexpanded orientation and the expanded position. There is a gap 36 between each pair of adjacent tabs 30 along the perimeter of the annular portion 22. The gaps 36 are sized so that the adjacent tabs do not overlap at any time. The required size of these substantially identical gaps 36, and their spacing along the inner radius 32, is a function of both the shape and the height-to-width ratio of the tabs 30.

As discussed in the '577 patent, the bottom member 16 can form a generally concave surface. The bottom edge 24 then provides a stable surface for resting the insulating cover 10 on a flat surface such as a tabletop. Since the tabs 30 do not overlap in the present design, the bottom member 16 can also be made flat, like a coaster, while still providing a stable resting surface for the insulating cover 10.

Figure 3:
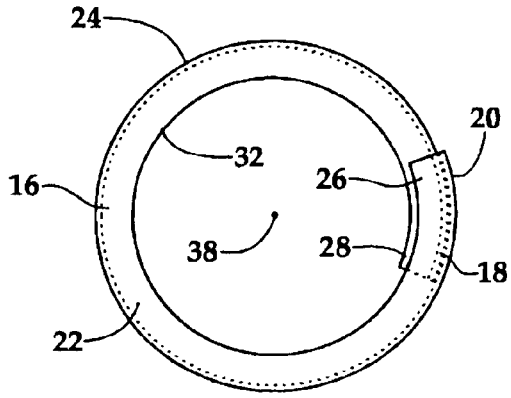
FIG. 3 is a bottom plan view of an alternative embodiment of the device in an unexpanded orientation.
Figure 4:
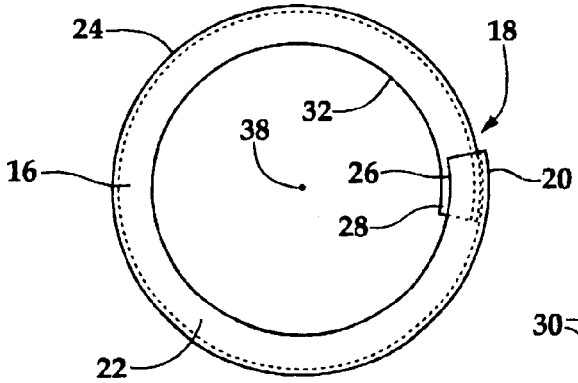
FIG. 4 is a bottom plan view thereof when the device is expanded as when holding a container.
Figure 5:
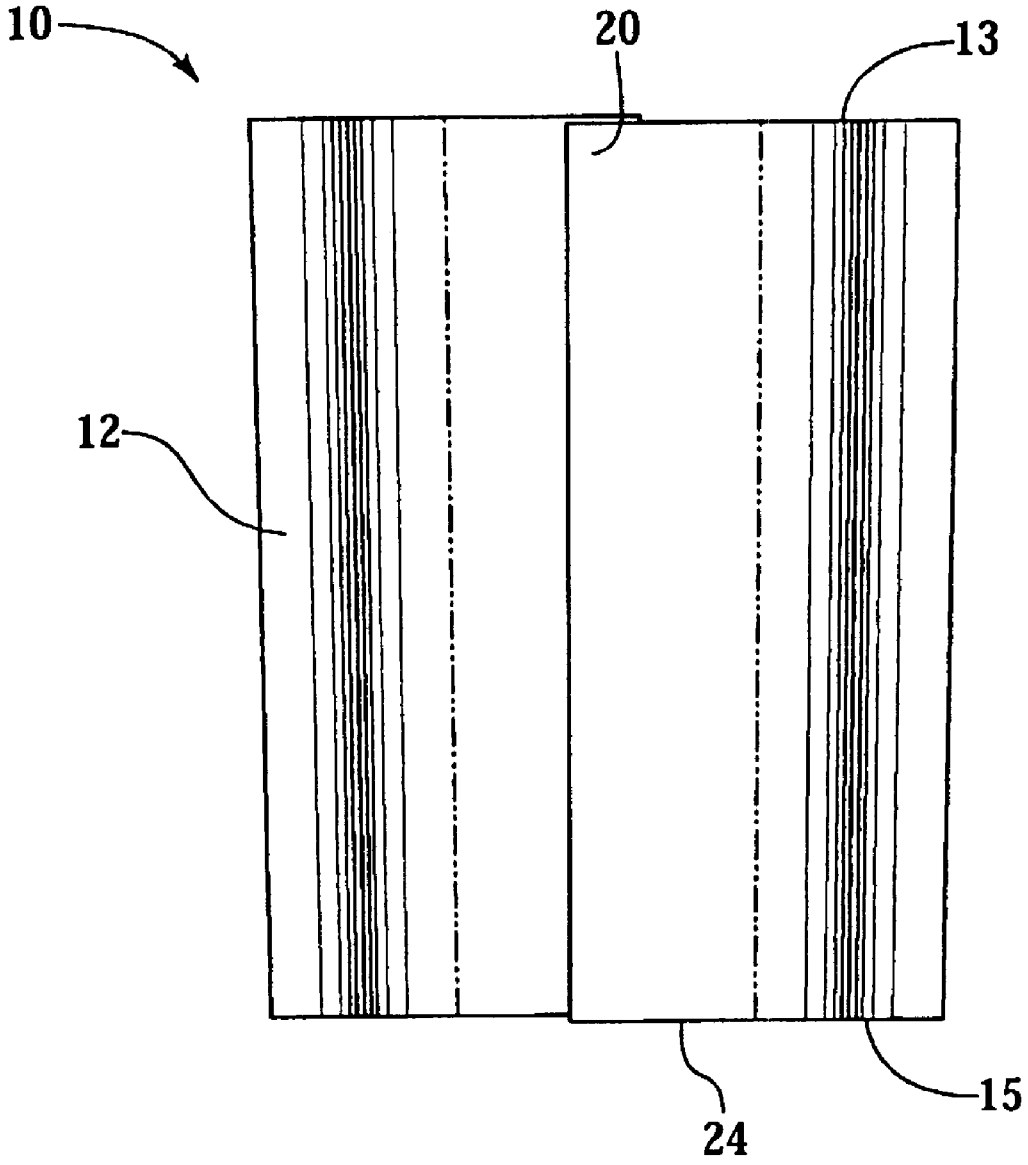
FIG. 5 is a side view of the alternative embodiment of FIG. 3, showing the overlapping nature of the sidewall end portions.

FIGS. 3 and 4 illustrate another embodiment (the elements depicted in FIG. 5 are the same for either embodiment). In this embodiment, the tabs 30 are absent, and the inner radius 32 of the annular portion 22 is selected so that the annular portion 22 securely engages the bottom of the container during use. While this embodiment can be used for containers having the bottom ring 34, there are practical limitations on how wide the annular portion 22 can be made. When the annular portion 22 is formed integrally with the sidewall member 12, increasing the width of the annular portion 22 can result in crimping of the annular portion 22 during manufacture. Too much crimping is undesirable, since this gives the bottom member 16 an undesirably uneven surface. A small amount of crimping is allowable, and can help allow the annular portion 22 to stretch during the expansion and contraction that occurs when inserting and removing containers.

For any embodiment, including both the embodiment of FIGS. 1 and 2 and the embodiment of FIGS. 3 and 4, the annular portion inner radius 32 is chosen to ensure that the annular portion 22 is able to hold the container 14 within the device without additional structure. The tabs 30 shown in the embodiment of FIGS. 1 and 2 are intended mainly to provide a means of engaging the bottom rim 34 of certain containers when the annular portion inner radius 32 cannot be extended all the way to the bottom ring without causing excessive crimping during fabrication or cracking during use, as discussed above. The tabs 30 are not required for holding the container 14 within the device.

The invention has been shown in two embodiments. It should be apparent to those skilled in the art that the invention is not limited to these embodiments, but is capable of being varied and modified without departing from the scope of the invention as set out in the attached claims.

What is claimed is:

1. An insulating cover for use with a container, comprising: a resilient substantially cylindrical sidewall member, formed to a preselected unexpanded orientation, defining two end pieces that overlap when the cover is in the unexpanded orientation; and a bottom member, for engaging and holding the container within the cover during use, the bottom member further comprising a continuous annular portion, having an inner radius, and defining two bottom sections that overlap when the cover is in the unexpanded orientation, and a plurality of non-overlapping tabs, integrally formed with the annular portion and extending from the annular portion inner radius toward the axis of the cylindrical sidewall member, the tabs being adapted to engage the container, and wherein the sidewall member and the bottom member are integrally formed from a single thin piece of insulating material.

2. An insulating cover as recited in claim 1, wherein the material used to fabricate the cover is selected from the group consisting of polyethylene foam and polystyrene foam.

3. An insulating cover for use with a container, comprising: a resilient substantially cylindrical sidewall member, formed to a preselected unexpanded orientation, defining two end pieces that overlap when the cover is in the unexpanded orientation; and a bottom member, for engaging and holding the container within the cover during use, the bottom member further comprising a continuous annular strip, having an inner radius, and defining two bottom sections that overlap when the cover is in the unexpanded orientation, and a plurality of non-overlapping tabs, integrally formed with the strip and extending from the strip inner radius toward the axis of the cylindrical sidewall member, the tabs being adapted to engage the container, and wherein the sidewall member and the bottom member are integrally formed from a single thin piece of insulating material.

4. An insulating cover as recited in claim 3, wherein the material used to fabricate the cover is selected from the group consisting of polyethylene foam and polystyrene foam.

* * * * *

UNITED STATES PATENT AND TRADEMARK OFFICE

CERTIFICATE OF CORRECTION

PATENT NO. : 6,464,100 B2
DATED : October 15, 2002
INVENTOR(S) : Charles L. Canfield It is certified that error appears in the above-identified patent and that said Letters Patent is hereby corrected as shown below:

Title page,
Item [57], ABSTRACT,
Line 6, "than" should read -- that --

Column 1,
Line 35, "an" should read -- a --

Column 2,
Lines 6 and 13, "an" should read -- a --

Signed and Sealed this

Twenty-sixth Day of August, 2003

JAMES E. ROGAN
*Director of the United States Patent and Trademark Office*